US008840418B2

(12) United States Patent
Chien

(10) Patent No.: US 8,840,418 B2
(45) Date of Patent: Sep. 23, 2014

(54) SOCKET STRUCTURE CAPABLE OF PREVENTING PLUG FROM DETACHING

(71) Applicant: Chao-Chuan Chien, New Taipei (TW)

(72) Inventor: Chao-Chuan Chien, New Taipei (TW)

( * ) Notice: Subject to any disclaimer, the term of this patent is extended or adjusted under 35 U.S.C. 154(b) by 82 days.

(21) Appl. No.: 13/713,252

(22) Filed: Dec. 13, 2012

(65) Prior Publication Data

US 2014/0170888 A1 Jun. 19, 2014

(51) Int. Cl.

| | |
|---|---|
| ***H01R 4/50*** | (2006.01) |
| ***H01R 13/625*** | (2006.01) |
| ***H01R 13/639*** | (2006.01) |
| ***H01R 13/635*** | (2006.01) |
| *H01R 24/22* | (2011.01) |
| *H01R 103/00* | (2006.01) |

(52) U.S. Cl.

CPC ..... *H01R 13/635* (2013.01); *H01R 13/6392* (2013.01); *H01R 24/22* (2013.01); *H01R 2103/00* (2013.01)

USPC ..... 439/346; 439/270

(58) Field of Classification Search

CPC ..... H01R 13/20; H01R 13/6275; H01R 13/6272; H01R 13/627; H01R 2103/00

USPC ..... 439/346, 270, 352, 347

See application file for complete search history.

(56) References Cited

U.S. PATENT DOCUMENTS

| | | | | |
|---|---|---|---|---|
| 1,939,259 | A * | 12/1933 | Good | 200/51.05 |
| 1,976,501 | A * | 10/1934 | James | 439/269.2 |
| 4,136,919 | A * | 1/1979 | Howard et al. | 439/346 |
| 4,566,187 | A * | 1/1986 | Chen | 29/857 |
| 5,145,393 | A * | 9/1992 | Schoon | 439/269.2 |
| 6,875,040 | B1 * | 4/2005 | O'Keefe et al. | 439/346 |
| 7,484,986 | B1 * | 2/2009 | Wu | 439/346 |
| 7,588,451 | B2 * | 9/2009 | Chen | 439/269.2 |
| 8,246,363 | B2 | 8/2012 | Lo | |
| 8,287,298 | B2 | 10/2012 | Hsu | |
| 8,382,507 | B2 * | 2/2013 | Yamaguchi et al. | 439/369 |
| 8,545,251 | B2 * | 10/2013 | Gordon et al. | 439/346 |

* cited by examiner

*Primary Examiner* — Hae Moon Hyeon

(74) *Attorney, Agent, or Firm* — Guice Patents PLLC

(57) ABSTRACT

The present invention relates to a socket structure capable of preventing plug from detaching, which comprises: a housing; a first base; a first electrode plate; a second electrode plate; a first button, one end thereof is extended with a first rod; and a second button, one end thereof is extended with a second rod; when the first button and the second button are pressed, the first electrode plate and the second electrode plate are respectively abutted by the first rod and the second rod, thereby allowing a plug to be released from the first electrode plate and the second electrode plate.

20 Claims, 6 Drawing Sheets

SOCKET STRUCTURE CAPABLE OF PREVENTING PLUG FROM DETACHING

BACKGROUND OF THE INVENTION

1. Field of the Invention

The present invention relates to a socket structure, especially to a socket structure capable of preventing plug from detaching, which is installed with a first button and a second button, when the first button and the second button are pressed, a plug is enabled to be released from a first electrode plate and a second electrode plate.

2. Description of Related Art

It is commonly known that a power socket is used for being inserted by a plug for obtaining the AC power. A conventional power socket is installed with reeds for clamping the firewire plate, the neutral plate and the ground plate of a plug thereby forming an electrical conducting state. However, after being used for a period of time, the clamping force provided by the reeds to the electrode plates would be gradually reduced, thereby causing the plug not being able to be effectively and stably secured in the socket.

Therefore, a safety plug is developed and available in the marketplace, the safety plug can be stably inserted in a socket and is prevented from being easily or accidentally detached, thereby achieving the objective of detaching prevention. For example, the safety socket disclosed in the U.S. Pat. No. 8,246,363 comprises an insertion block in which an inner housing and two support frames are installed; an opening is formed on the inner housing, one sidewall of the inner housing is formed with two insertion holes, and a protrusion is formed on at least one sidewall adjacent to the insertion holes; the two support frames are received in the inner housing, each of the support frame includes a fence which is fastened in the inner housing; a base which includes an outer housing and two guide arms; the outer housing is formed with an opening, and the outer housing is covered at an opened end of inner housing of the insertion block; at least one sidewall of the outer housing is formed with a slot, each slot is formed at the outer side of the corresponding protrusion of the inner housing; the two guide arms are secured in the base and respectively corresponding to the support frames of the insertion block; a conducting unit disposed between the two support frames of the insertion block and including a ratchet wheel, a pawl, a driving assembly and an electrical connection assembly; the ratchet wheel is pivoted at one end of the electrical connection assembly; one end of the pawl is pivoted in the inner housing, the other end thereof is abutted against the periphery of the ratchet wheel; the driving assembly is installed at the other end of the electrical connection assembly, and the driving assembly includes a disk, a support arm and a locating link; one sidewall of the disk is formed with plural locating recesses; one end of the support arm is installed in the outer housing, and the other end of the support arm is mutually pivoted with the locating link; one sidewall of the locating link is formed with a locating protrusion, the locating protrusion is engaged in the corresponding locating recess of the disk; the electrical connection assembly includes a carrier and plural conducting rods; the carrier is formed as a solid cylinder and disposed between the two guide arms of the base, the carrier is formed with plural longitudinal grooves; each of the conducting rods is received in the corresponding longitudinal groove of the carrier and two ends of each of the conducting rods are respectively connected and secured with the ratchet wheel and the disk; the carrier is formed with a spindle, the ratchet wheel, the disk and the locating link are respectively formed with a center hole, the spindle of the carrier is mounted through the center holes; when two blades of a plug are inserted in the insertion block and inwardly pressed, the electrical connection assembly is driven to rotate and electrically connected with the two blades and the two guide arms, the two blades are clamped between the conducting unit and the support frames thereby enabling the two blades to be difficult to be removed; when the plug is desired to be removed, the insertion block is pressed again and the electrical connection assembly is driven to rotate again, thereby enabling the plug to be easily to be removed. However, the structure of the cited patent is complicated therefore the production cost would be inevitably increased.

For example, the detachment-preventing plug disclosed in the U.S. Pat. No. 8,287,298 comprises a body unit, two conducting pins, a slider member and two resilient hooking members. The body unit defines a compartment for receiving the slider member. Each of the resilient hooking members has a protruding portion and an exposing hooking end. Each of the protruding portions protrudes toward the slider member and is engaged with the slider member, and a hooking portion is formed on each of the exposing hooking ends. The two conducting pins have two slots respectively. When the two conducting pins are inserted into the socket, the two resilient hooking members are adapted to pass through the two slots and hook the socket by the two hooking portions, wherein a user could drive the slider to make the two resilient hooking members establish a releasing configuration or a hooking configuration. However, this detachment-preventing design is for the plug, instead of a socket.

As such, how to design a novel socket structure capable of preventing plug from detaching for improving the mentioned shortages shall be seriously concerned.

SUMMARY OF THE INVENTION

One primary objective of the present invention is to provide a socket structure capable of preventing plug from detaching, which is installed with a first button and a second button, when the first button and the second button are pressed, a plug is enabled to be released from a first electrode plate and a second electrode plate.

For achieving the above-mentioned objective, the present invention provides a socket structure capable of preventing plug from detaching, which includes: a housing formed with a hollow chamber, two sides of the hollow chamber are respectively formed with a first round hole and a second round hole; a first base received in the hollow chamber and formed with a first room and a second room, one side of the first room is formed with a first insertion hole, the other side is formed with a first fasten seat, one side of the second room is formed with a second insertion hole, the other side is formed with a second fasten seat; a first electrode plate received in the first room, the front end thereof is formed with a reversed hook, the rear end thereof is formed with a through hole, and is fastened on the first fasten seat; a second electrode plate received in the second room, the front end thereof is formed with a reversed hook, the rear end thereof is formed with a through hole, and is fastened on the second fasten seat; a first button, one end thereof is extended with a first rod which is received in the first round hole, and the first rod is sleeved with a first spring; and a second button, one end thereof is extended with a second rod which is received in the second round hole, and the second rod is sleeved with a second spring; when the first button and the second button are respectively pressed, the first electrode plate and the second electrode plate are respectively abutted by the first rod and the second rod, thereby allowing a plug to be released from the first electrode plate and the second electrode plate.

For achieving the above-mentioned objective, the present invention provides a socket structure capable of preventing plug from detaching, which comprises: a first housing formed with a hollow chamber, two bottom sides of the hollow chamber are respectively formed with a first guide slot and a second guide slot, a guide column is formed between the first guide slot and the second guide slot; a first base having a partition board at the center, the bottom thereof is formed with a first guide rail and a second guide rail corresponding to the first guide slot and the second guide slot, and formed with a guide groove corresponding to the guide column, thereby enabling the first base to be received in the hollow chamber and formed with a first room and a second room, one side of the first room is formed with a first insertion slot, the other side is formed with a first fasten column, one side of the second room is formed with a second insertion slot, the other side is formed with a second fasten column; a first electrode plate received in the first room, the front end thereof is formed with a reversed hook, a first protrusion is extended at the location opposite to the reversed hook, the rear end thereof is formed with a through hole, and is fastened on the first fasten column; a second electrode plate received in the second room, the front end thereof is formed with a reversed hook, a second protrusion is extended at the location opposite to the reversed hook, the rear end thereof is formed with a through hole, and is fastened on the second fasten column; a first spring, one end thereof is sleeved on the first protrusion, the other end thereof is disposed adjacent to one side of the partition board; a second spring, one end thereof is sleeved on the second protrusion, the other end thereof is disposed adjacent to the other side of the partition board; a second base covered on top of the first base; and a second housing covered the outer side of the first housing, and formed with a first insertion hole, a second insertion hole, a first stop block and a second stop block, and an inclined surface is respectively formed on the first stop block and the second stop block; after being assembled, the second housing is backwardly pushed, so the front ends of the first electrode plate and the second electrode plate are respectively abutted against the inclined surfaces of the first stop block and the second stop block, thereby enabling the first electrode plate and the second electrode plate to inwardly move and allowing a plug to be released from the first electrode plate and the second electrode plate.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
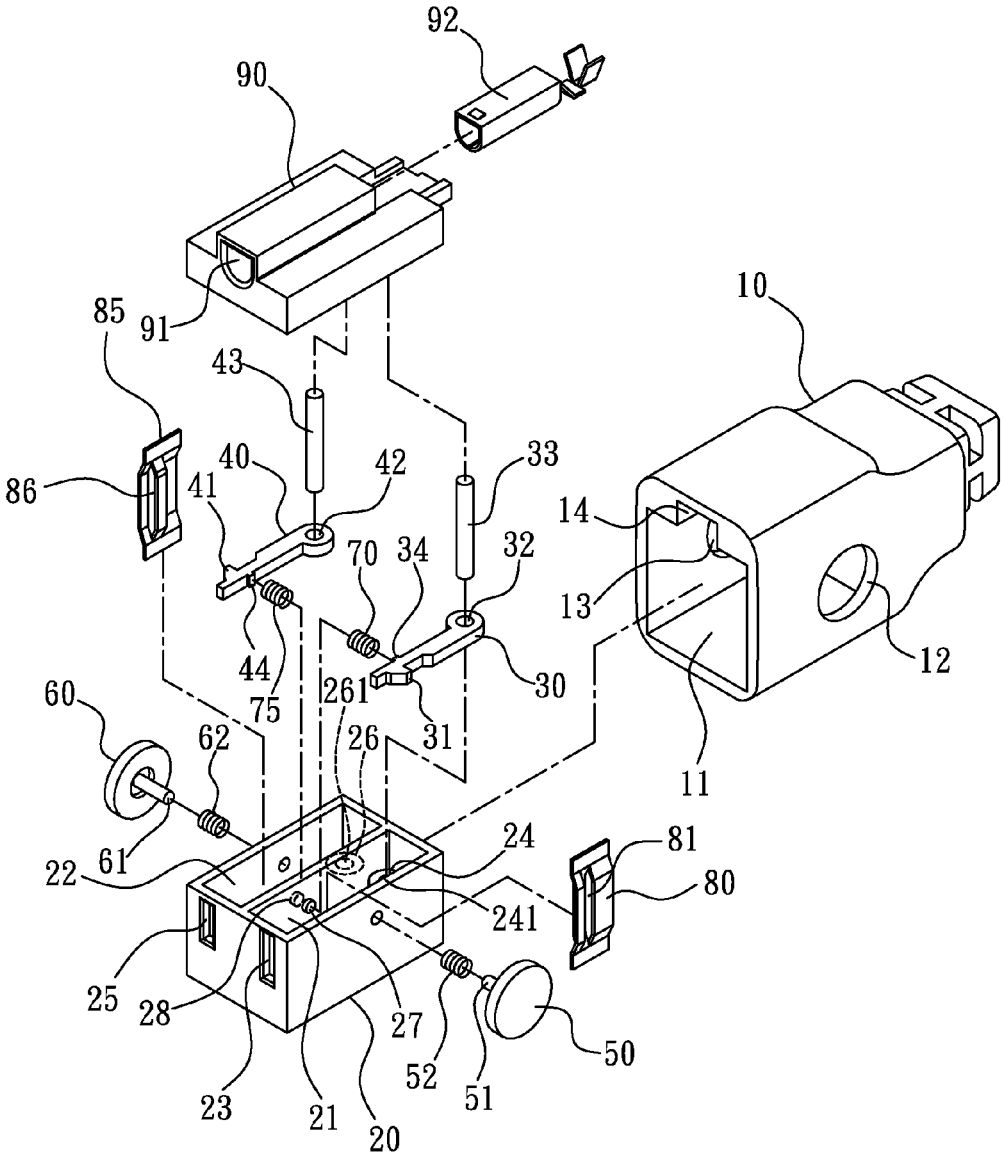
FIG. 1 is a perspective exploded view illustrating the socket structure capable of preventing plug from detaching, according to one preferred embodiment of the present invention.
Figure 2:
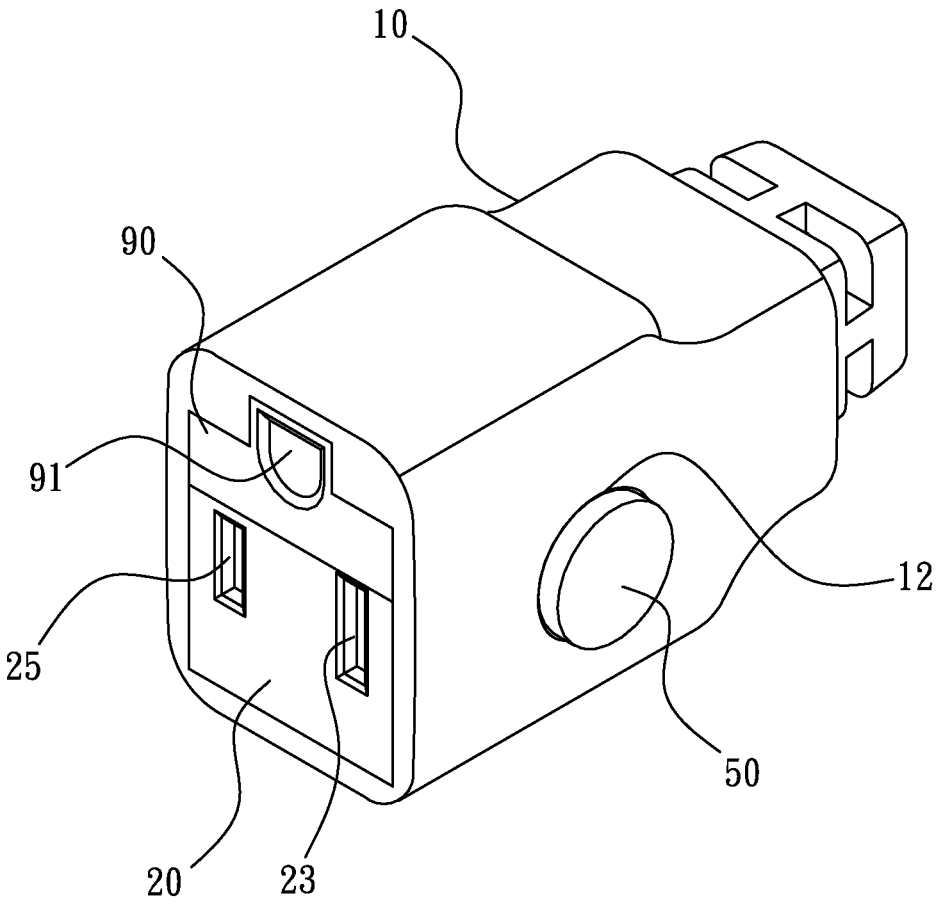
FIG. 2 is a schematic view illustrating the assembly of the socket structure capable of preventing plug from detaching, according to one preferred embodiment of the present invention.

Referring to FIG. 1 and FIG. 2, wherein FIG. 1 is a perspective exploded view showing the socket structure capable of preventing plug from detaching, according to one preferred embodiment of the present invention; and FIG. 2 is a schematic view showing the assembly of the socket structure capable of preventing plug from detaching, according to one preferred embodiment of the present invention.

As shown in figures, the socket structure capable of preventing plug from detaching according to one preferred embodiment of the present invention comprises: a housing 10; a first base 20; a first electrode plate 30; a second electrode plate 40; a first button 50 and a second button 60.

The housing 10 is made of an insulation material, e.g. but not limited to plastic, and is formed with a hollow chamber 11. Two sides of the hollow chamber 11 are respectively formed with a first round hole 12 and a second round hole 13. In addition, the top end of the hollow chamber 11 is further formed with a slot hole 14.

The first base 20 is made of an insulation material, e.g. but not limited to plastic, disposed in the hollow chamber 11, and is formed with a first room 21 and a second room 22. One side of the first room 21 is formed with a first insertion hole 23, the other side is formed with a first fasten seat 24. One side of the second room 22 is formed with a second insertion hole 25, the other side is formed with a second fasten seat 26. In addition, the first fasten seat 24 is formed with a first fasten hole 241, and the second fasten seat 26 is formed with a second fasten hole 261. The first insertion hole 23 is e.g. but not limited to a firewire hole, and the second insertion hole 25 is e.g. but not limited to a neutral hole. Moreover, the first room 21 and the second room 22 are respectively formed with a first cylinder 27 and a second cylinder 28, and the first cylinder 27 and the second cylinder 28 are adjacently arranged.

The first electrode plate 30 is disposed in the first room 21, and the front end thereof is formed with a reversed hook 31, the rear end thereof is formed with a through hole 32. A first fasten column 33 is provided for passing the through hole 32 and the first fasten hole 241 thereby fastening the first electrode plate 30 on the first fasten seat 24. In addition, the first electrode plate 30 is extended with a first protrusion 34 at the location opposite to the reversed hook 31.

The second electrode plate 40 is disposed in the second room 22, and the front end thereof is formed with a reversed hook 41, the rear end thereof is formed with a through hole 42.

A second fasten column 43 is provided for passing the through hole 42 and the second fasten hole 261 thereby fastening the second electrode plate 40 on the second fasten seat 26. In addition, the second electrode plate 40 is extended with a second protrusion 44 at the location opposite to the reversed hook 41.

One end of the first button 50 is extended with a first rod 51 which is received in the first round hole 12. In addition, the first rod 51 is further sleeved with a first spring 52.

One end of the second button 60 is extended with a second rod 61 which is received in the second round hole 13. In addition, the second rod 61 is further sleeved with a second spring 62.

According to the present invention, the socket structure capable of preventing plug from detaching is further provided with a third spring 70 and a fourth spring 75, wherein one end of the third spring 70 is disposed at an outer side of the first cylinder 27, the other end is adjacently disposed at an outer side of the first protrusion 34; one end of the fourth spring 75 is disposed at an outer side of the second cylinder 28, the other end is adjacently disposed at an outer side of the second protrusion 44.

According to the present invention, the socket structure capable of preventing plug from detaching is further provided with a first retain sheet 80 and a second retain sheet 85, wherein the first retain sheet 80 is made of a metal material, disposed in the first room 21 and adjacent to the first electrode plate 30, a first clamp space 81 is defined between two sides of the first retain sheet 80; the second retain sheet 85 is made of a metal material, disposed in the second room 22 and adjacent to the second electrode plate 40, a second clamp space 86 is defined between two sides of the second retain sheet 85.

According to the present invention, the socket structure capable of preventing plug from detaching is further provided with a second base 90, which is received in the hollow chamber 11 and disposed above the first base 20, and the top end of the second base 90 is further formed with a third room 91. The third room 91 is received in the slot hole 14 and provided with a third electrode plate 92. The third electrode plate 92 is e.g. but not limited to a ground plate.

As shown in FIG. 2, when being assembled, for example but not limited to that the first fasten column 33 penetrates the through hole 32 and the first fasten hole 241 thereby fastening the first electrode plate 30 on the first fasten seat 24; the second fasten column 43 penetrates the through hole 42 and the second fasten hole 261 thereby fastening the second electrode plate 40 on the second fasten seat 26; one end of the third spring 70 is disposed at the outer side of the first cylinder 27, the other end is adjacently disposed at the outer side of the first protrusion 34; one end of the fourth spring 75 is disposed at the outer side of the second cylinder 28, the other end is adjacently disposed at the outer side of the second protrusion 44; the first retain sheet 80 is received in the first room 21 and disposed adjacent to the first electrode plate 30; the second retain sheet 85 is received in the second room 22 and disposed adjacent to the second electrode plate 40; the first base 20 is disposed in the hollow chamber 11; the third electrode plate 92 is disposed in the third room 91, and the second base 90 is received in the hollow chamber 11 and disposed above the first base 20; the first spring 52 is disposed at the outer side of the first rod 51 then the first button 50 is received in the first round hole 12, thereby allowing the first rod 51 to be tightly adjacent to the first electrode plate 30; the second spring 62 is disposed at the outer side of the second rod 61 then the second button 60 is received in the second round hole 13, thereby allowing the second rod 61 to be tightly adjacent to the second electrode plate 40. Accordingly, the assembly of the socket structure capable of preventing plug from detaching provided by the present invention is finished.

Figure 3:
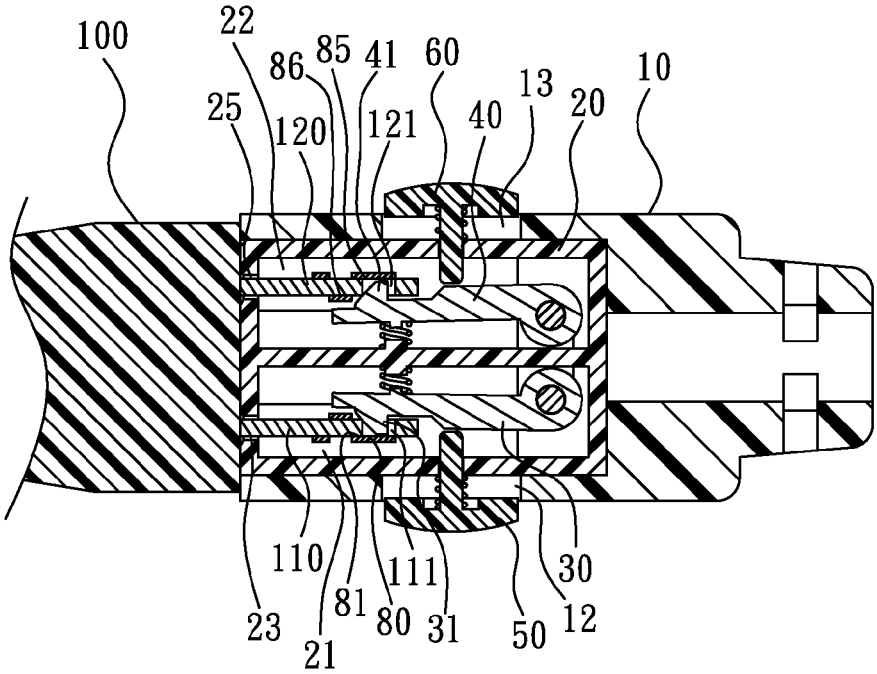
FIG. 3 is a cross sectional view illustrating a plug being inserted in the socket structure capable of preventing plug from detaching, according to one preferred embodiment of the present invention.
Figure 4:
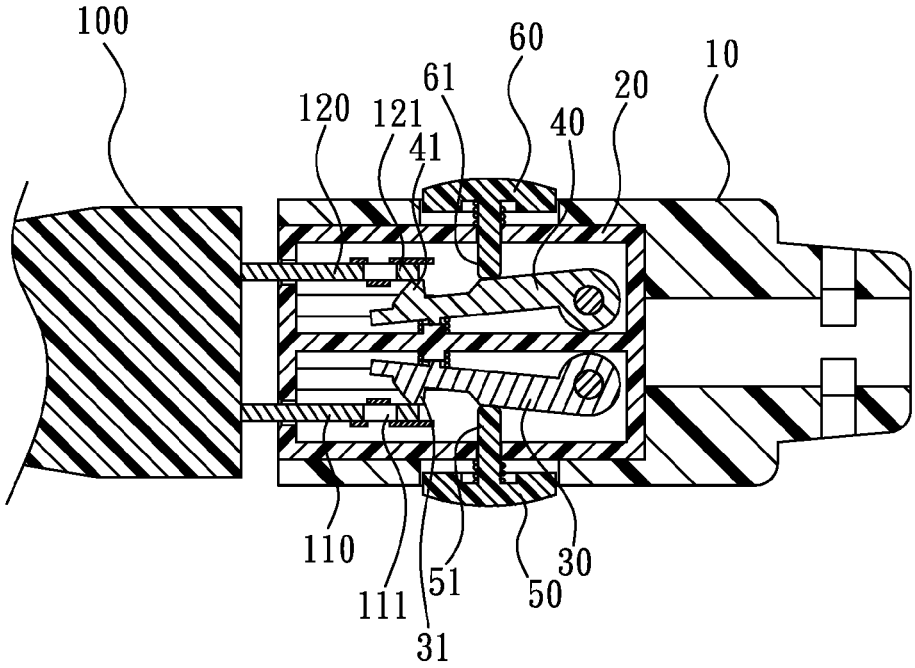
FIG. 4 is a cross sectional view illustrating the first button and the second button being pressed for allowing the plug to be released, according to one preferred embodiment of the present invention.

Referring to FIG. 3 and FIG. 4, wherein FIG. 3 is a cross sectional view illustrating a plug being inserted in the socket structure capable of preventing plug from detaching, according to one preferred embodiment of the present invention; and FIG. 4 is a cross sectional view illustrating the first button and the second button being pressed for allowing the plug to be released, according to one preferred embodiment of the present invention As shown in FIG. 3, when a plug 100 is inserted in the socket of the present invention, a firewire plate 110 and a neutral plate 120 of the plug 100 are respectively received in the first room 21 and the second room 22 through the first insertion hole 23 and the second insertion hole 25, then the firewire plate 110 is enabled to enter the first clamp space 81 of the first retain sheet 80, the neutral plate 120 is enabled to enter the second clamp space 86 of the second retain sheet 85, when the plug 100 is further pushed forwardly, a wire hole 111 of the firewire plate 110 is hooked by the reversed hook 31 of the first electrode plate 30, a wire hole 121 of the neutral plate 120 is hooked by the reversed hook 41 of the second electrode plate 40, thereby preventing the plug 100 from being detached from the socket of the present invention.

As shown in FIG. 4, when the plug 100 is desired to be pulled out, the first button 50 and the second button 60 are respectively pressed, so the first electrode plate 30 is inwardly pushed by the first rod 51 thereby allowing the wire hole 111 of the firewire plate 110 to be released from the reversed hook 31 of the first electrode plate 30, and second electrode plate 40 is inwardly pushed by the second rod 61 thereby allowing the wire hole 121 of the neutral plate 120 to be released from the reversed hook 41 of the second electrode plate 40, therefore the plug 100 can be smoothly pulled out from the socket of the present invention. As such, the socket structure capable of preventing plug from detaching provided by the present invention has advantages of simplified structure and easy to be operated.

As what has been disclosed above, the socket structure capable of preventing plug from detaching provided by the present invention is installed with a first button and a second button, when the first button and the second button are pressed, a plug is enabled to be released from the first electrode plate and the second electrode plate; and the present invention has the advantages of simplified structure and easy to be operated. As such, the socket capable of preventing plug from detaching provided by the present invention is novel and can be practically applied for various purposes, while being compared to conventional sockets.

Figure 5:
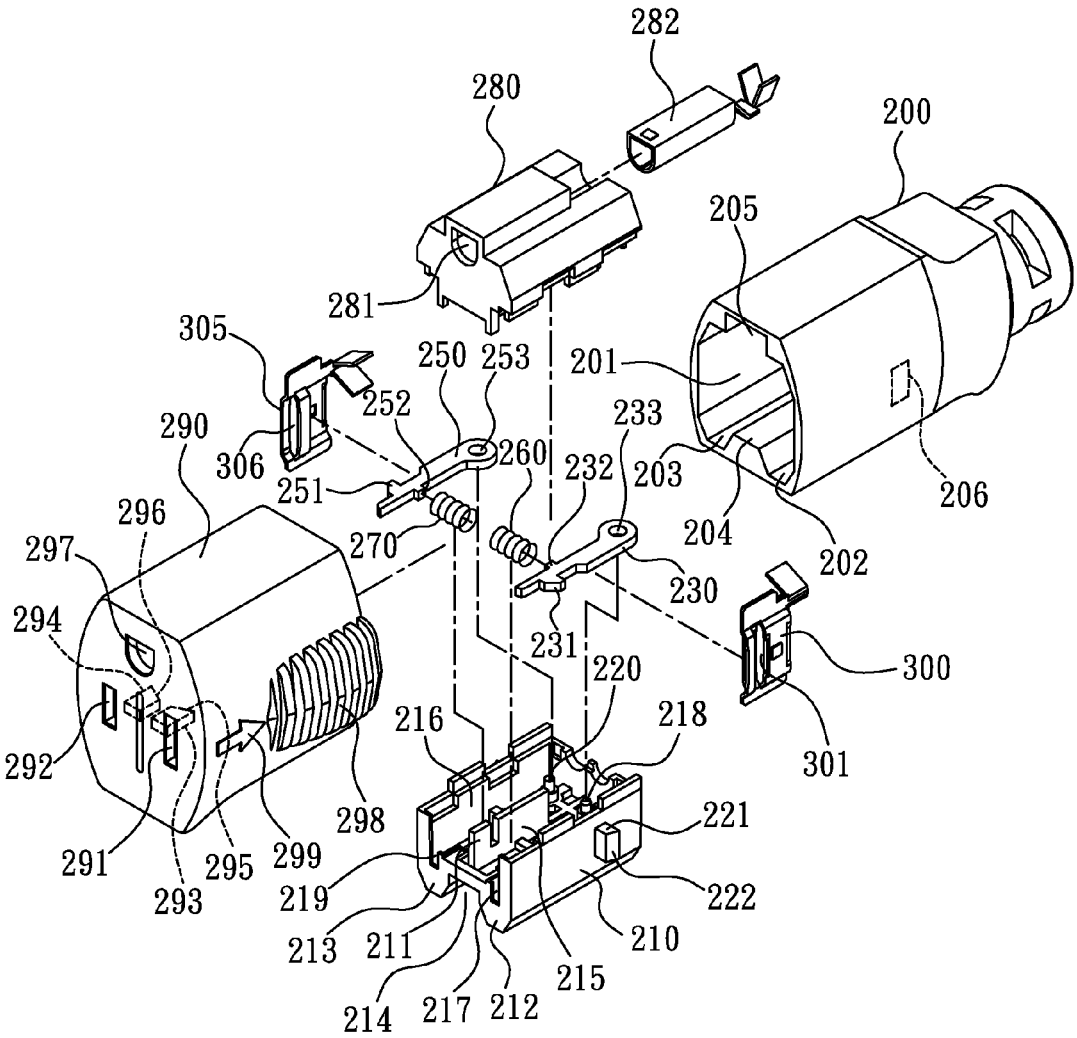
FIG. 5 is an exploded view illustrating the socket structure capable of preventing plug from detaching, according to another preferred embodiment of the present invention.
Figure 6:
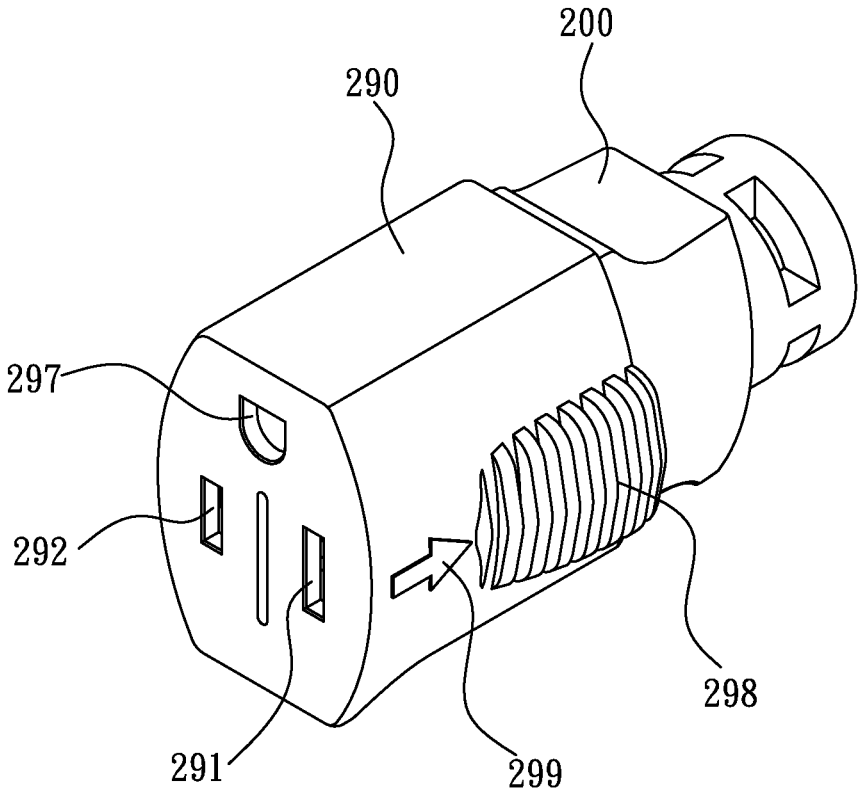
FIG. 6 is a schematic view illustrating the assembly of the socket structure capable of preventing plug from detaching, according to another preferred embodiment of the present invention.

Referring to FIG. 5 and FIG. 6, wherein FIG. 5 is an exploded view illustrating the socket structure capable of preventing plug from detaching, according to another preferred embodiment of the present invention; and FIG. 6 is a schematic view illustrating the assembly of the socket structure capable of preventing plug from detaching, according to another preferred embodiment of the present invention.

As shown in figures, the socket structure capable of preventing plug from detaching according to another preferred embodiment of the present invention comprises: a first housing 200; a first base 210; a first electrode plate 230; a second electrode plate 250; a first spring 260; a second spring 270; a second base 280; and a second housing 290.

The first housing 200 is made of an insulation material, e.g. but not limited to plastic, and is formed with a hollow chamber 201. Two bottom sides of the hollow chamber 201 are respectively formed with a first guide slot 202 and a second guide slot 203, and a guide column 204 is formed between the first guide slot 202 and the second guide slot 203. In addition, the top end of the hollow chamber 201 is further formed with a slot hole 205.

The first base 210 is made of an insulation material, e.g. but not limited to plastic, formed with a partition board 211 at the center, the bottom thereof is formed with a first guide rail 212 and a second guide rail 213 corresponding to the first guide slot 202 and the second guide slot 203, and formed with a guide groove 214 corresponding to the guide column 204, thereby the first base 210 being enabled to be slideably disposed in the hollow chamber 201. The first base 210 is formed with a first room 215 and a second room 216, one side of the first room 215 is formed with a first insertion slot 217, the other side is formed with a first fasten column 218, one side of the second room 216 is formed with a second insertion slot 219, the other side is formed with a second fasten column 220. In addition, two sides of the first base 210 are respectively formed with an engaging block 221 on which an inclined surface 222 is formed.

The first electrode plate 230 is received in the first room 215, the front end thereof is formed with a reversed hook 231, a first protrusion 232 is extended at the location opposite to the reversed hook 231, the rear end thereof is formed with a through hole 233, and the through hole 233 is sleeved on the first fasten column 218 thereby fastening the first electrode plate 230.

The second electrode plate 250 is received in the second room 216, the front end thereof is formed with a reversed hook 251, a second protrusion 252 is extended at the location opposite to the reversed hook 251, the rear end thereof is formed with a through hole 253, and the through hole 253 is sleeved on the second fasten column 220 thereby fastening the second electrode plate 250.

One end of the first spring 260 is sleeved on the first protrusion 232, the other end thereof is disposed adjacent to one side of the partition board 211, e.g. but not limited to the right side.

One end of the second spring 270 is sleeved on the second protrusion 252, the other end thereof is disposed adjacent to the other side of the partition board 211, e.g. but not limited to the left side.

The second base 280 is made of an insulation material, e.g. but not limited to plastic, and covered on top of the first base 210. In addition, the top end of the second base 280 is further formed with a third room 281 which can be accommodated in the slot hole 205, and the third room 281 is provided with a third electrode plate 282.

Figure 7:
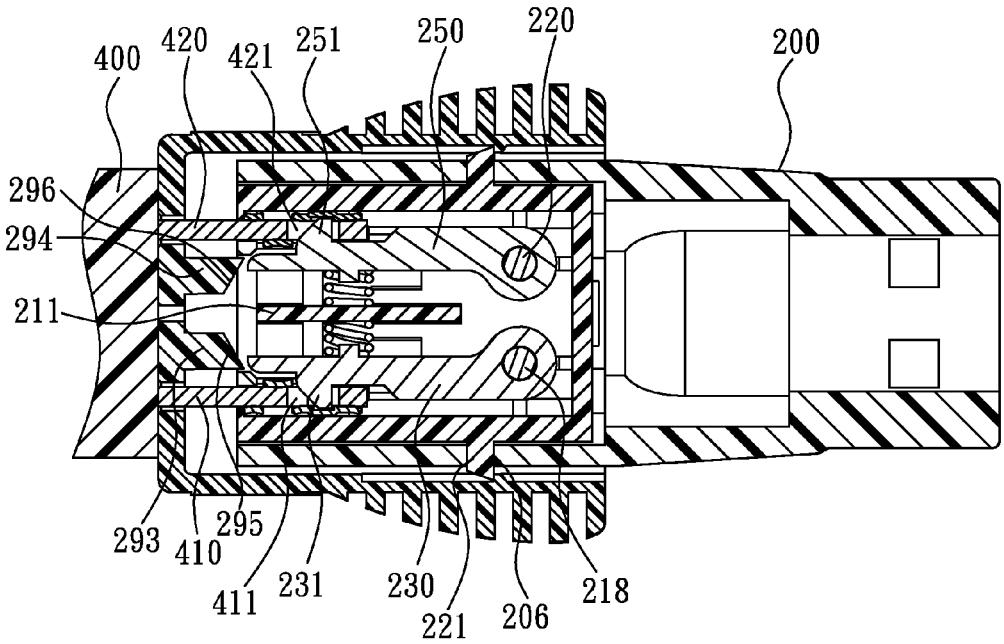
FIG. 7 is a cross sectional view illustrating a plug being inserted in the socket structure capable of preventing plug from detaching, according to another preferred embodiment of the present invention.
Figure 8:
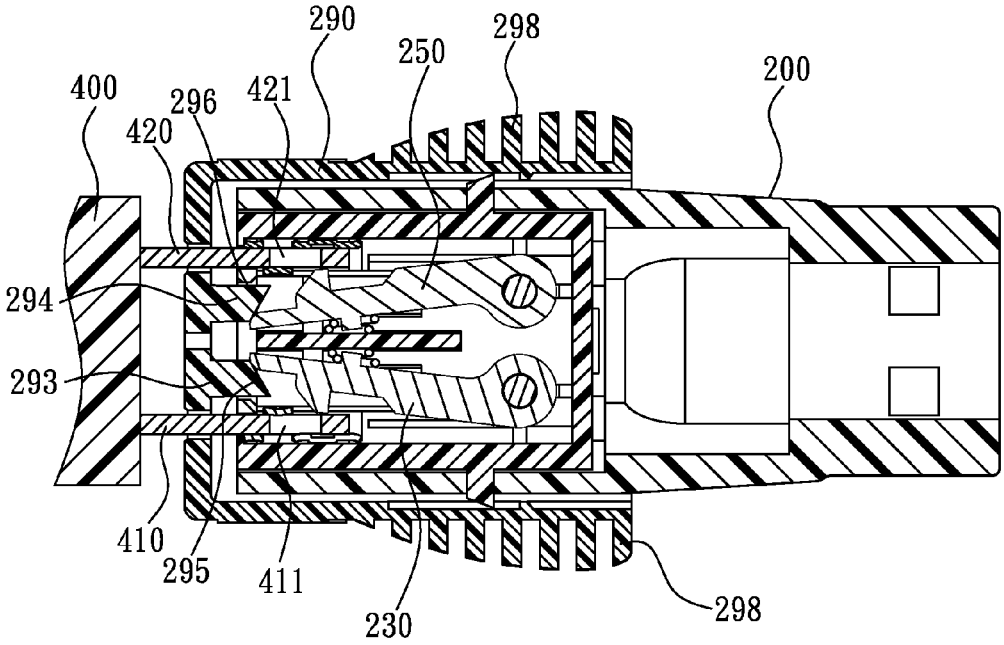
FIG. 8 is a cross sectional view illustrating the second housing being backwardly moved for allowing the plug to be released, according to another preferred embodiment of the present invention.

The second housing 290 is made of an insulation material, e.g. but not limited to plastic, covered the outer side of the first housing 200, and formed with a first insertion hole 291, a second insertion hole 292, a first stop block 293 and a second stop block 294 (as shown in FIG. 7 and FIG. 8), and the first stop block 293 and the second stop block 294 are disposed at the inner side of the second housing 290, the front ends thereof are respectively formed with an inclined surface 295, 296 which are respectively corresponding to the front ends of the first electrode plate 230 and the second electrode plate 250. In addition, the top end of the second housing 290 is further formed with a third insertion hole 297 corresponding to the third room 281. Wherein, the first insertion hole 291 is e.g. but not limited to a neutral hole, the second insertion hole 292 is e.g. but not limited to a firewire hole, the third insertion hole 297 is e.g. but not limited to a ground hole.

In addition, the socket structure capable of preventing plug from detaching provided by the present invention further includes a first retain sheet 300 and a second retain sheet 305, wherein the first retain sheet 300 is made of a metal material, disposed in the first room 215 and adjacent to the first electrode plate 230, a first clamp space 301 is defined between two sides thereof; the second retain sheet 305 is made of a metal material, disposed in the second room 216 and adjacent to the second electrode plate 250, a second clamp space 306 is defined between two sides thereof.

Moreover, according to the socket structure capable of preventing plug from detaching provided by the present invention, two sides of the first housing 200 are respectively formed with an engaging slot 206 corresponding to the engaging blocks 221, thereby allowing the engaging blocks 221 to be engaged.

Moreover, according to the socket structure capable of preventing plug from detaching provided by the present invention, two sides of the second housing 290 are respectively formed with at least a protrusion 298, an external force can be applied for separating the second housing 290 and the first housing 200, and the front end of the protrusion 298 is formed with a direction indicating arrow 299.

As shown in FIG. 6, when being assembled, for example but not limited to that the first electrode plate 230 and the second electrode plate 250 are respectively fastened on the first fasten column 218 and the second fasten column 220; one end of the first spring 260 is sleeved on the first protrusion 232, the other end thereof is disposed adjacent to the right side of the partition board 211; one end of the second spring 270 is sleeved on the second protrusion 252, the other end thereof is disposed adjacent to the left side of the partition board 211; the first retain sheet 300 is disposed in the first room 215 and adjacent to the first electrode plate 230; the second retain sheet 305 is disposed in the second room 216 and adjacent to the second electrode plate 250; the third electrode plate 282 is disposed in the third room 281; the second base 280 is covered on the first base 210 then slideably disposed in the hollow chamber 201, thereby enabling the engaging blocks 221 to be engaged in the engaging slots 206; lastly the second housing 290 is installed at the outer side of the first housing 200. Accordingly, the assembly of the socket structure capable of preventing plug from detaching provided by the present invention is finished.

Referring to FIG. 7 and FIG. 8, wherein FIG. 7 is a cross sectional view illustrating a plug being inserted in the socket structure capable of preventing plug from detaching, according to another preferred embodiment of the present invention; and FIG. 8 is a cross sectional view illustrating the second housing being backwardly moved for allowing the plug to be released, according to another preferred embodiment of the present invention.

As shown in FIG. 7, when a plug 400 is inserted in the socket of the present invention, a firewire plate 420 and a neutral plate 410 of the plug 400 are respectively received in the first room 215 and the second room 216 through the first insertion hole 291 and the second insertion hole 292, then the neutral plate 410 is enabled to enter the first clamp space 301 of the first retain sheet 300, the firewire plate 420 is enabled to enter the second clamp space 306 of the second retain sheet 305, when the plug 400 is further pushed forwardly, a wire hole 411 of the neutral plate 410 is hooked by the reversed hook 231 of the first electrode plate 230, a wire hole 421 of the firewire plate 420 is hooked by the reversed hook 251 of the second electrode plate 250, thereby preventing the plug 400 from being detached from the socket of the present invention.

As shown in FIG. 8, when the plug 400 is desired to be pulled out, external forces are respectively applied to the protrusions 298 formed at two sides of the second housing 290 for being forwardly pushed, so the inclined surfaces 295, 296 of the first stop block 293 and the second stop block 294 are respectively abutted against the front ends of the first electrode plate 230 and the second electrode plate 250; while the external forces being continuously applied, the front ends of the first electrode plate 230 and the second electrode plate 250 are moved respectively along the inclined directions of the inclined surfaces 295, 296, thereby allowing the wire hole 411 of the neutral plate 410 to be released from the reversed hook 231 of the first electrode plate 230 and allowing the wire hole 421 of the firewire plate 420 to be released from the reversed hook 251 of the second electrode plate 250, therefore the plug 400 can be smoothly pulled out from the socket of the present invention. As such, the socket structure capable of preventing plug from detaching provided by the present invention has advantages of simplified structure and easy to be operated.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A socket structure capable of preventing a plug from detaching, comprising:

a housing formed with a hollow chamber, two sides of said hollow chamber being respectively formed with a first round hole and a second round hole;

a first base received in said hollow chamber and formed with a first room and a second room, one side of said first room being formed with a first insertion hole, the other side being formed with a first fasten seat, one side of said second room being formed with a second insertion hole, the other side being formed with a second fasten seat;

a first electrode plate received in said first room, the front end thereof being formed with a reversed hook, the rear end thereof being formed with a through hole, and being fastened on said first fasten seat;

a second electrode plate received in said second room, the front end thereof being formed with a reversed hook, the rear end thereof being formed with a through hole, and being fastened on said second fasten seat;

a first button, one end thereof being extended with a first rod which being received in said first round hole, and said first rod being sleeved with a first spring; and a second button, one end thereof being extended with a second rod which being received in said second round hole, and said second rod being sleeved with a second spring;

wherein, the first electrode plate and the second electrode plate are movable between a first position and a second position;

wherein, when the first electrode plate and the second electrode plate are located in the first position, each of the reversed hook of the first electrode and the reversed hook of the second electrode are inserted into a corresponding hole selected from a group consisting of a wire hole of a firewire plate of the plug and a wire hole of a neutral plate of the plug, and the plug is secured to the socket structure;

wherein, when the first electrode plate and the second electrode plate are located in the second position, each of the reversed hook of the first electrode and the reversed hook of the second electrode are withdrawn from the corresponding hole selected from the group consisting of the wire hole of the firewire plate of the plug and the wire hole of the neutral plate of the plug, and the plug is capable of being selectively removed and inserted into the socket structure;

wherein, when said first button and said second button being pressed, said first electrode plate and said second electrode plate being respectively abutted by said first rod and said second rod and moved to the second position, thereby allowing the plug to be released from said first electrode plate and said second electrode plate.

2. The socket structure capable of preventing the plug from detaching as claimed in claim 1, wherein said housing and said base are made of an insulation material, said first insertion hole is a neutral hole, said second insertion hole is a firewire hole.

3. The socket structure capable of preventing the plug from detaching as claimed in claim 1, further including a first fasten column, and said first fasten seat is formed with a first fasten hole, said first fasten column is provided for penetrating said through hole and said first fasten hole thereby fastening said first electrode plate on said first fasten seat.

4. The socket structure capable of preventing the plug from detaching as claimed in claim 1, further including a second fasten column, said second fasten seat is formed with a second fasten hole, said second fasten column is provided for penetrating said through hole and said second fasten hole thereby fastening said second electrode plate on said second fasten seat.

5. The socket structure capable of preventing the plug from detaching as claimed in claim 1, wherein said first electrode plate is extended with a first protrusion at the location opposite to said reversed hook, said second electrode plate is extended with a second protrusion at the location opposite to said reversed hook, wherein said first room and said second room are respectively formed with a first cylinder and a second cylinder, and said first cylinder and said second cylinder are adjacently disposed.

6. The socket structure capable of preventing the plug from detaching as claimed in claim 5, further including:

a third spring, one end thereof is disposed at the outer side of said first cylinder, the other end thereof is adjacently disposed at the outer side of said first protrusion; and a fourth spring, one end thereof is disposed at the outer side of said second cylinder, the other end thereof is adjacently disposed at the outer side of said second protrusion.

7. The socket structure capable of preventing the plug from detaching as claimed in claim 6, further including:

a first retain sheet, disposed in said first room and adjacent to said first electrode plate, a first clamp space is defined between two sides thereof; and a second retain sheet, disposed in said second room and adjacent to said second electrode plate, a second clamp space is defined between two sides thereof.

8. The socket structure capable of preventing the plug from detaching as claimed in claim 1, wherein the top end of said hollow chamber is formed with a slot hole.

9. The socket structure capable of preventing the plug from detaching as claimed in claim 8, further including a second base received in said hollow chamber and disposed above said first base, and the top end of said second base is further formed with a third room, said third room is received in said slot hole and provided with a third electrode plate.

10. The socket structure capable of preventing the plug from detaching as claimed in claim 9, wherein said third electrode plate is a ground plate.

11. A socket structure capable of preventing a plug from detaching, comprising:

a first housing, formed with a hollow chamber, two bottom sides of said hollow chamber being respectively formed with a first guide slot and a second guide slot, a guide column being formed between said first guide slot and said second guide slot;

a first base, having a partition board at the center, the bottom thereof being formed with a first guide rail and a second guide rail corresponding to said first guide slot and said second guide slot, and formed with a guide groove corresponding to said guide column, thereby enabling said first base to be received in said hollow chamber and formed with a first room and a second room, one side of said first room being formed with a first insertion slot, the other side being formed with a first fasten column, one side of said second room being formed with a second insertion slot, the other side being formed with a second fasten column;

a first electrode plate, received in said first room, the front end thereof being formed with a reversed hook, a first protrusion being extended at the location opposite to said reversed hook, the rear end thereof being formed with a through hole, and being fastened on said first fasten column;

a second electrode plate, received in said second room, the front end thereof being formed with a reversed hook, a second protrusion being extended at the location opposite to said reversed hook, the rear end thereof being formed with a through hole, and being fastened on said second fasten column;

a first spring, one end thereof being sleeved on said first protrusion, the other end thereof being disposed adjacent to one side of said partition board;

a second spring, one end thereof being sleeved on said second protrusion, the other end thereof being disposed adjacent to the other side of said partition board;

a second base, covered on top of said first base; and a second housing, covered the outer side of said first housing, and formed with a first insertion hole, a second insertion hole, a first stop block and a second stop block, and an inclined surface being respectively formed on said first stop block and said second stop block;

wherein, the first electrode plate and the second electrode plate are movable between a first position and a second position;

wherein, when the first electrode plate and the second electrode plate are located in the first position, each of the reversed hook of the first electrode and the reversed hook of the second electrode are inserted into a corresponding hole selected from a group consisting of a wire hole of a firewire plate of the plug and a wire hole of a neutral plate of the plug, the plug is secured to the socket structure;

wherein, when the first electrode plate and the second electrode plate are located in the second position, each of the reversed hook of the first electrode and the reversed hook of the second electrode are withdrawn from the corresponding hole selected from a group consisting of the wire hole of the firewire plate of the plug and the wire hole of the neutral plate of the plug, the plug is capable of being selectively removed and inserted into the socket structure;

wherein, when said second housing is backwardly pushed, so the front ends of said first electrode plate and said second electrode plate are respectively abutted against said inclined surfaces of said first stop block and said second stop block, thereby enabling said first electrode plate and said second electrode plate to inwardly move to the second position and allowing the plug to be released from said first electrode plate and said second electrode plate.

12. The socket structure capable of preventing the plug from detaching as claimed in claim 11, wherein said first housing, said second housing, said first base and said second base are made of an insulation material.

13. The socket structure capable of preventing the plug from detaching as claimed in claim 11, further including:

a first retain sheet, disposed in said first room and adjacent to said first electrode plate, a first clamp space is defined between two sides thereof; and a second retain sheet, disposed in said second room and adjacent to said second electrode plate, a second clamp space is defined between two sides thereof.

14. The socket structure capable of preventing the plug from detaching as claimed in claim 11, wherein said first insertion hole is a neutral hole, said second insertion hole is a firewire hole.

15. The socket structure capable of preventing the plug from detaching as claimed in claim 11, wherein the top end of said hollow chamber is formed with a slot hole.

16. The socket structure capable of preventing the plug from detaching as claimed in claim 15, wherein the top end of said second housing is further formed with a third insertion hole, the top end of said second base is further formed with a third room corresponding to said third insertion hole, said third room is accommodated in said slot hole, and said third room is provided with a third electrode plate.

17. The socket structure capable of preventing the plug from detaching as claimed in claim 11, wherein said third electrode plate is a ground plate.

18. The socket structure capable of preventing the plug from detaching as claimed in claim 11, wherein two sides of said first base are respectively formed with an engaging block, and said engaging block is formed with an inclined surface.

19. The socket structure capable of preventing the plug from detaching as claimed in claim 18, wherein two sides of said first housing are respectively formed with an engaging slot corresponding to said engaging blocks, thereby allowing said engaging blocks to be engaged.

20. The socket structure capable of preventing the plug from detaching as claimed in claim 11, wherein two sides of said second housing are respectively formed with at least a protrusion, an external force is applied for separating said second housing and said first housing, and the front end of said protrusion is formed with a direction indicating arrow.

* * * * *